United States Patent [19]

Deutsch et al.

[11] 4,337,681

[45] Jul. 6, 1982

[54] POLYPHONIC SLIDING PORTAMENTO WITH INDEPENDENT ADSR MODULATION

[75] Inventors: Ralph Deutsch; Leslie J. Deutsch, both of Sherman Oaks, Calif.

[73] Assignee: Kawai Musical Instrument Mfg. Co., Ltd., Hamamatsu, Japan

[21] Appl. No.: 178,246

[22] Filed: Aug. 14, 1980

[51] Int. Cl.[3] ..... G10H 1/057; G10H 1/22; G10H 7/00

[52] U.S. Cl. ..... 84/1.24; 84/1.13; 84/1.26; 84/DIG. 2

[58] Field of Search ..... 84/1.01, 1.03, 1.13, 84/1.24, 1.26, DIG. 2

[56] References Cited

U.S. PATENT DOCUMENTS

| | | | |
|---|---|---|---|
| 3,929,053 | 12/1975 | Deutsch | 84/1.24 |
| 4,022,098 | 5/1977 | Deutsch et al. | 84/1.03 |
| 4,067,254 | 1/1978 | Deutsch et al. | 84/1.01 |
| 4,079,650 | 3/1978 | Deutsch et al. | 84/1.26 |
| 4,085,644 | 4/1978 | Deutsch et al. | 84/1.01 |
| 4,103,581 | 8/1978 | Deutsch | 84/1.24 |

*Primary Examiner*—Stanley J. Witkowski
*Attorney, Agent, or Firm*—Ralph Deutsch

[57] ABSTRACT

A keyboard operated musical instrument is disclosed having a portamento effect controlled from a portamento keyboard consisting of a linear array of keyswitches. The keyswitches are arranged in groups corresponding to each musical note and spaced so that a number of contiguous switches are actuated by each finger in contact with the portamento keyboard. Apparatus is provided for generating a frequency number corresponding to the closest switch actuated by the center of each finger thereby providing polyphonic portamento effects as the finger positions are slid along the portamento keyboard. An ADSR generator is used to provide envelope modulations initiated when a new finger has been detected on the slide wire and when a finger has been removed. A priority logic using frequency differences is used to distinguish between new fingers or the changes in position of a finger already in contact with the slide wire.

22 Claims, 10 Drawing Figures

MASTER CLOCK
NOTE COUNTER
OCTAVE COUNTER
SCAN RESET
END OF SCAN
F/F
R
S
Q
CARRY
D
CONTACT LATCHES
CONTACT SCAN COUNTER
FINGER COUNTER
END FINGER
EDGE DETECTOR
EDGE DETECTOR
START FINGER
FREQUENCY NUMBER GENERATOR
GATE
NEAREST NOTE
FREQUENCY NUMBER REGISTER 3
FREQUENCY NUMBER REGISTER 2
FREQUENCY NUMBER REGISTER 3
1
2
3
4
5
6
7
8
10
11
12
13
14
15
16
17
18
19
20
21
22
23
24
25
26
27
28
70
71
72
73
74

POLYPHONIC SLIDING PORTAMENTO WITH INDEPENDENT ADSR MODULATION

BACKGROUND OF THE INVENTION

1. Field of the Invention

This invention relates broadly in the field of electronic musical tone generators and in particular is concerned with providing a sliding polyphonic portamento effect.

2. Description of the Prior Art

Several of the conventional acoustical type orchestral musical instruments have the capability of producing continuous portamento effects. For a portamento effect the musical pitches are not changed abruptly in a transition from one note to the next, but rather glide smoothly in a continuous frequency transition between the pitches of the two notes. These instruments include the unfretted string instruments and the slide trombone. The novel musical effect of the portamento is especially useful in contemporary music and a variety of schemes have been used to imitate portamento transitions for keyboard electronic musical instruments.

A keyboard portamento system is disclosed in U.S. Pat. No. 4,103,581 entitled "Constant Speed Portamento." In the disclosed system each keyboard switch controls the pitch of the generated tone through a table of frequency numbers. The portamento effect of having the pitch of one note slide smoothly into the pitch of the next note is achieved by subtracting the frequency number of the new note to be generated from the frequency number controlling the frequency of the note currently being generated. A fraction of the difference is stored in an increment register and added over and over to the frequency number of the current note at a controlled rate until the frequency number equals the frequency control number of the new note. Thus the frequency transition from the first to the second note takes place in a fixed number of incremental steps, the transition time being independent of the difference in pitch between the two successive notes.

In U.S. Pat. No. 3,929,053, entitled "Production Of Glide And Portamento In An Electronic Musical Instrument" another version of a portamento system is described. The frequency transition is accomplished by successively adding and accumulating a frequency increment to an initial frequency number corresponding to the first note. Eventually the accumulated sum of the previous frequency number and the added increments will essentially equal the frequency number of the newly selected note. Thereafter tone production continues at the true pitch of the new note. In this fashion the time required for the portamento transition will depend upon the frequency separation between the two notes.

Both of the portamento effects produced by the systems described in the referenced patents produce frequency transitions having an almost mechanical-like precision in that once a speed control has been set the transition time is automatically predetermined. Moreover the start frequency and the end frequency are restricted to be true musical pitches instead of having the desirable capability of deliberately ending or starting on "detuned" notes. The lip smear effect commonly used by brass instrument musicians cannot be realistically imitated by these systems.

Electronic musical instruments have been built which obtain continuous frequency transitions by the use of a slide-wire control. The pressure of a finger in mechanical contact with the slide-wire is used to produce a variable voltage magnitude which is employed to control the frequency of a voltage controlled oscillator. The slide-wire controlled portamento system offers a wide latitude of control for the musician and permits him to produce some remarkable and novel musical effects. This system suffers from mechanical problems in the implementation of the slide-wire contacts as well as in the frequency stability problems encountered in having a given position on the wire correspond to a specified frequency. The usual slide-wire portamento system is inherently monophonic in operation.

A novel "slide-wire" portamento system is described in the copending patent application Ser. No. 167,305 filed on July 10, 1980 and entitled "Polyphonic Sliding Portamento In A Musical Instrument." This application has the same inventors as the present invention and both are assigned to the same assignee. In the referenced application a slide-wire is implemented as a linear array of touch sensitive switches having a plurality of contacts associated with each keyboard note in a preselected musical note range. Detection and assignor circuitry is used to detect the contacts actuated by a number of fingers and to assign frequency numbers to the contacts closest to the center of a group of contacts actuated by each finger. Circuitry is used to ignore contacts operated by more than some preselected number of fingers. If a full quota of finger contacts has been detected, a new contact scan is initiated in a manner which reduces scan time.

A frequency number is assigned to a tone generator corresponding to each of the allowable number of fingers. The frequency numbers correspond to the center contact of a group spanned by a finger. Two modes of operation are disclosed. In the unfretted mode, the assigned frequency numbers correspond to the selected key contact while in the fretted mode, the assigned frequency numbers correspond to the closest musical pitch.

SUMMARY OF THE INVENTION

A slide wire is implemented as a linear array of touch sensitive contact switches having a plurality of contacts associated with each keyboard note in a preselected musical note range. Detection and assignor circuitry is used to detect the contacts actuated by a number of fingers and to assign frequency numbers to the contacts closest to the center of a group of contacts actuated by each finger. The assignment of tone generators is made using a system decision logic employing a frequency closeness criterion to determine if a new note has been attacked, if a note has been released, or if a previously attacked note has shifted to a new position on the slide-wire. If a new note has been detected, a signal is sent to an ADSR envelope generator to create the output tone's ADSR modulation. If a note has been determined as having been released, a note release signal is sent to the ADSR generator to create the tone release envelope function.

The portamento system incorporates a search and assign mode. During the search mode, the actuated switch contacts are detected and the center contact of each group is determined. The search mode time interval is not a fixed time but will vary according to the number of fingers in contact with the slide-wire. During the assign mode the frequency numbers are generated and assigned to a tone generator.

It is an object of this invention to produce polyphonic portamento effects having frequency transitions determined by the displacement of the musician's fingers and having an ADSR envelope modulation responsive to newly actuated or released fingers.

It is a further object of this invention to make tone generator assignments using a criterion of frequency closeness between slide-wire contact transitions.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

In the copending patent application Ser. No. 167,305 a system is disclosed for providing a polyphonic portamento of the slide-wire type for an electronic musical instrument. The slide-wire consists of a linear array of touch sensitive switches. A limitation of the system disclosed in the referenced application is that provision is not incorporated for an ADSR envelope modulation of the individual tones associated with each finger in contact with the slide-wire, or finger board.

The abbreviation ADSR is commonly used to denote the four regions of a musical tone's envelope amplitude variations. These are attack (A), decay (D), sustain (S), and release (R). The attack region is that portion at the onset of the tone until the envelope modulation reaches its maximum value. The decay region is the region between the end of the attack and a quasi-steady amplitude that is maintained during most of the tone's duration. The release region is that region between the time at which the keyswitch is released and the tone decays completely. The sustain region is the region between the end of the decay region and the start of the release region.

For a wide variety of musical effects it is desirable to augment the slide-wire portamento system so that an ADSR envelope is applied to each new note introduced by placing a finger in contact with the fingerboard. The signals required to control an ADSR generator are usually obtained by means of a note detect and assignor system. A typical note detect and assignor system is described in U.S. Pat. No. 4,022,098 entitled "Keyboard Switch Detect And Assignor" which is hereby incorporated by reference. One method of detecting the changes in the state of a given keyboard switch is to scan the keyboard switches and memorize the state of each actuated switch. If a change in state is found on a succeeding scan, then either a new note has been actuated or an old note has been released.

The usual note detect and assign logic systems are not easily applicable to a slide-wire polyphonic portamento system because the fingers can readily change in position by many key contact positions between detection scans. For this reason it is desirable to abandon an assignment logic predicated only on the switch states of keyboard switches and use a logic predicated on the desired tonal effects to be obtained from the slide-wire, or finger board. Thus the tone generator assignment logic described below which provides control signals for an ADSR generator uses a detection logic based on a decision of "closest frequency."

Figure 1:
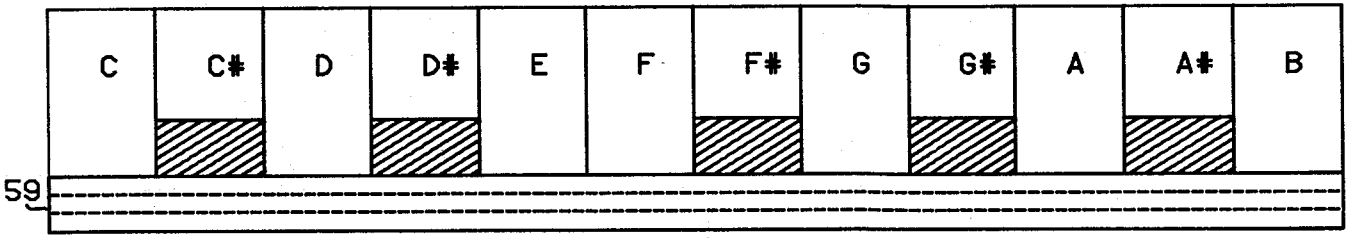
FIG. 1 is a schematic of the portamento slide-wire.

A portamento slide-wire 59 is shown schematically by the dashed-lines in FIG. 1. The term slide-wire is used herein in a generic sense to include a linear array of electrical switches as well as a variable resistance having a plurality of contact points. Each musical note shown in FIG. 1 contains the same number of switches. The musical note letters are provided as printed legends adjacent to the slide-wire 59 to aid the musician in positioning his fingers to obtain desired notes and chord combinations. FIG. 1 illustrates one octave of the portamento slide-wire. Any number of octaves can be added and it is generally found that a three octave range is adequate for most musical instruments. The cross-hatch areas on the note legends correspond to the position of the black notes on a conventional piano-like keyboard.

For illustration, the invention is described for a slide-wire configured to have eight sets of switch contacts for each note of the diatonic musical scale. Eight finger contacts per note is an advantageous choice and does not represent a restriction of, or a limitation of the invention. Since each full note change in a musical transition corresponds to 100 cents of frequency change, each finger contact change on the slide-wire will produce a frequency change of $100/8=12.5$ cents. This frequency change is small enough to cause the ear to sense a continuous change in frequency transitions rather than to sense a set of discrete frequency steps for a frequency portamento transition.

The musical tone generating systems to be used in conjunction with the present invention are of the type that employ frequency numbers to control the pitch of a generated musical tone. In U.S. Pat. No. 4,067,254 entitled "Frequency Number Controlled Clocks" there is described a method of using frequency numbers to control the frequency of a voltage controlled oscillator suitable for use in a musical tone generator. This patent is hereby incorporated by reference.

In U.S. Pat. No. 4,085,644 entitled "Polyphonic Tone Synthesizer" there is described a musical tone generator employing voltage controlled oscillators of the type described in the above referenced patent. U.S. Pat. No. 4,085,644 is hereby incorporated by reference.

A frequency number is assigned to each of several fingers which are touching the finger keyboard contacts which constitute the slide wire. For illustrative purposes in describing the invention, a polyphonic system capable of producing three simultaneous tones is used. This number is not a limitation of the invention and from the following description it is apparent that the number can be expanded.

Figure 2:
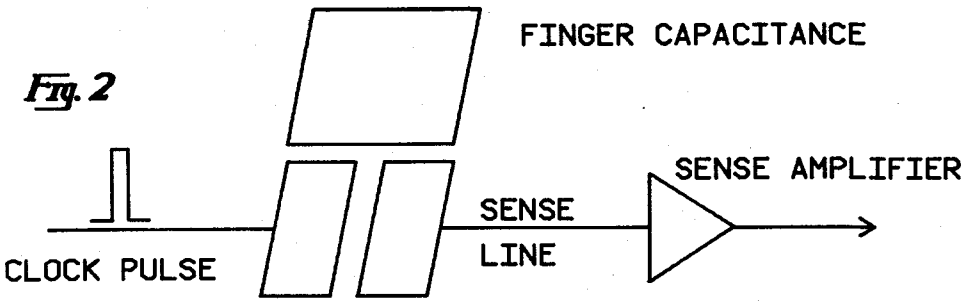
FIG. 2 illustrates a capacitance switch.

The key contacts comprising the linear switch array of the slide-wire can be implemented in a variety of ways. One method is to use capacitance type switches as shown in FIG. 2. The capacitance change introduced by the finger enables the contact clock pulse to be transmitted to a sense amplifier. The sense amplifier transmits a clock pulse when the capacitance change has exceeded some predetermined threshold value. Touch sensitive switches can also be implemented using variable resistances where the finger is used to provide a resistance path between two contacts. The bridging resistance change is detected by sense amplifiers. Touch switches have also been implemented to detect changes in the ambient temperature produced by the heat transferred from a finger in contact with the switch.

The finger-board comprising the slide-wire is constructed to have a smooth surface so that the fingers are easily slid between the contacts.

Figure 3:
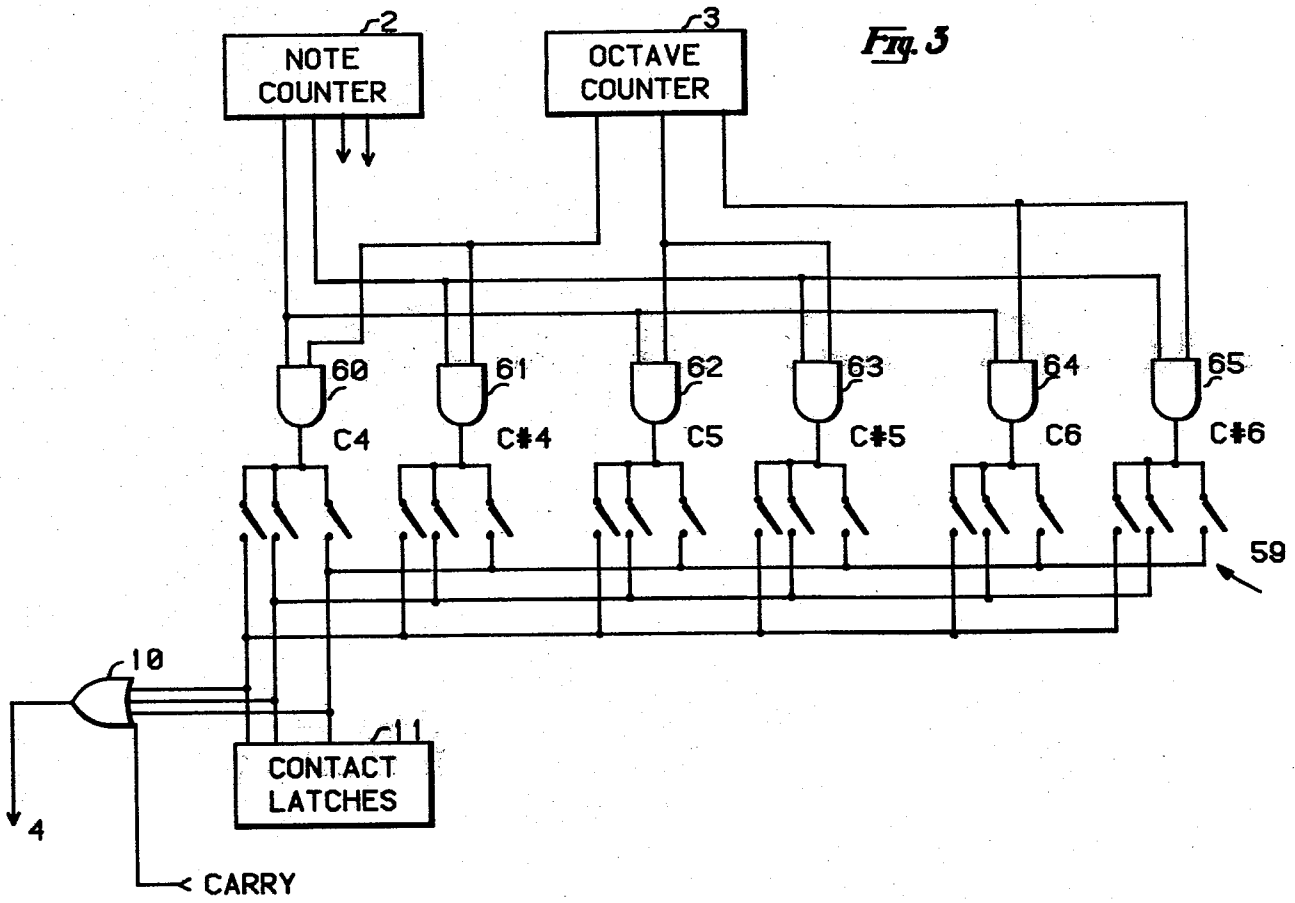
FIG. 3 illustrates the connection circuitry for the slide-wire switch controls.

The switch contacts for the slide-wire are connected to detect and assign logic circuitry as illustrated in FIG. 3. Each switch is a symbolic representation of touch sensitive switches as shown in FIG. 2 and has an input and output signal terminal. The switches are connected in an arrangement which can be called "connected in parallel notes." All the first contacts for each note are connected together, all the second contacts for each note are connected together, and so on for the set of eight switch contacts associated with each note. A common sense amplifier can be used for all the switch output terminals noded to a single point.

A set of AND-gates 60 to 65 are provided to scan the finger-board in a manner to be described below. AND-gate 60 corresponds to the musical note $C_4$ and its output is connected to the input terminals of the eight switch contacts associated with this note. A similar AND-gate is provided for each note in the range of notes spanned by the finger-board, or slide-wire, 59.

The note counter 2 is a counter that is implemented to count modulo 12. Each of its count states corresponds to a note in a musical octave. The lowest count state is connected as an input signal to the set of AND-gates 60, 62, 64. These gates all correspond to the musical note C. The second count state is connected to the AND-gates corresponding to C#. The remaining count states are connected in a similar fashion to the remaining set of AND gates which are not shown explicitly in FIG. 3, that correspond to the remaining notes in a musical octave.

The octave counter 3 is a counter that is implemented to count modulo 3 which is the number of musical octaves in the range spanned by the finger-board 59. The lowest count state of this counter is connected to the 12 AND-gates corresponding to the notes $C_4$ to $B_4$ of the finger-board. The second count state is connected to the set of 12 AND-gates corresponding to the notes $C_5$ to $B_5$ and the third count state is connected to the AND-gate 64 which corresponds to the set of 12 AND-gates for the notes $C_6$ to $B_6$.

The contact latches 11 consists of a register memory which acts as a scratch pad memory to temporarily store the switch states of finger-board 59. All the first switch contacts for each note are connected to the highest bit position in the register contained in the contact latches 11. All the second switch contacts are connected to the second highest bit position. Finally, all the eighth switch contacts for each note are connected to the lowest bit position in this register.

Figure 4:
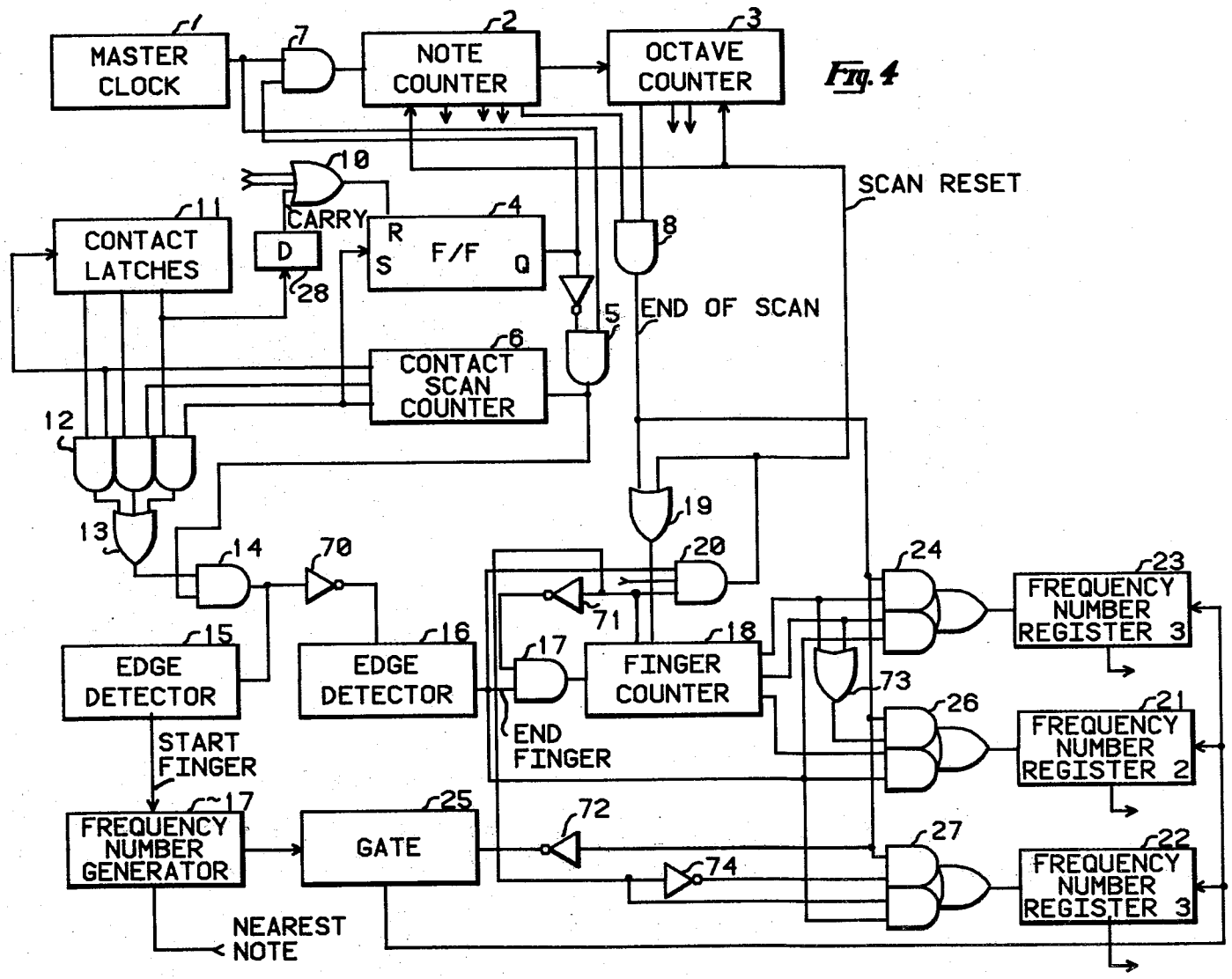
FIG. 4 is a schematic of the note detect and frequency assign logic.

All the switch contacts are summed in the OR-gate 10 to provide a signal to the flip-flop 4 shown in FIG. 4. The output from the OR-gate, denoted by the reference numeral 4, is connected to the flip-flop 4. The CARRY signal input to OR-gate 10 is used in a manner described below to allow for the situation in which a finger is placed so that it simultaneously actuates switches for two adjacent musical notes.

FIG. 4 illustrates the detailed logic for detecting switch states on finger-board 59 and for assigning corresponding frequency numbers.

Master clock 1 is used to generate a sequence of timing pulses which are used to time and control the logic timing of the portamento system.

To start the explanation of the sequence of operations, it is assumed that initially flip-flop 4 has been reset so that its output state is Q="0". It will be evident from the logic that the system is in fact, self starting. In response to the state Q="0", the AND-gate 5 transfers master clock pulses which are used to increment the contact scan counter 6.

The contact scan counter 6 is implemented to count modulo N, where N is the number of switches per musical note in the finger-board 59. An advantageous choice is N=8. When the contact scan counter 6 is incremented to its maximum state, N=8, a signal is sent to set the flip-flop 4 so that its output state changes to Q="1". At this time, the contact scan counter is stopped at its maximum count state. The system has now been initialized and a search mode is initiated to search for fingers that may have actuated switches on the finger-board 59.

In response to the state Q="1", AND-gate 7 transmits signals from the master clock 1 which are used to increment the note counter 2. The note counter 2 is implemented to count modulo 12 which is the number of musical notes in an octave.

Each time that the note counter 2 is incremented so that it returns to its initial state because of its modulo counting implementation, a reset signal is generated which is used to increment the octave counter 3. Because the portamento is limited, for way of illustration, to a three octave range, the octave counter 3 is implemented to count modulo 3.

The state 12 (highest or maximum count state) from the note counter 2 is used as one signal input to the AND-gate 8 and the second input signal is the state 3 (highest or maximum count state) from the octave counter 3. Thus the output logic state from the AND-gate 8 will be "1" when both of these counters are simultaneously at their maximum count states. Thus the "1" state signifies the completion of a search scan of the states of the switches comprising the finger-board 59.

If a scan during the search mode detects a switch on the finger-board 59 in the actuated ("on") state, a signal is produced by the OR-gate 10 which will reset the flip-flop 4 and place its output state at Q="0". The state Q="0" will inhibit the AND-gate 7 and thereby "freezes" the current states of both the note counter 2 and octave counter 3. The current switch contact states for the set of finger contacts spanned by a finger in contact with the finger-board 59 is temporarily stored in the register contained in the contact latches 11. At this time, the search scan mode is interrupted and a frequency assignment mode is initiated.

The sequence, or set, of finger contacts spanned by a single finger is scanned by means of the contact scan counter 6. The contact scan counter is implemented by counter N=8 which is the number of switches implemented for each musical note on the finger-board 59. The output state Q="0" from the flip-flop 4 permits AND-gate 5 to transmit master clock timing pulses which increment the count states of the contact scan counter 6.

The individual count states from the contact scan counter 6 are decoded onto a set of N individual signal lines. A signal on the line corresponding to count state 1 is sent to the contact latches 11. At count state 1, the data register within the contact latches 12 is allowed to be set by the switch contact status of the input signal lines to the contact latches 12 from the finger-board 59 key switches. The individual count states on the signal lines from the contact scan counter 6 are each connected to one input of a member of the set of select gates 12. The switch closure contact data stored in the contact latches are connected to the second input of the AND-gates comprising the select gates 12. The end result is that the switch contact status data existing when the contact scan counter 6 is incremented to its initial count state (count state 1) is scanned into the AND-gate 14 as contact scan counter 6 is incremented for its N count states. The output logic state from AND-gate 14 will be a "1" if a data signal is found in the register within the contact latches 11 corresponding to a closed (actuated) switch on the finger-board 59.

Edge detector 15 will generate a logic "1" state signal if the sequence of input data contains a "0" logic state followed by a "1" logic state. This change in logic states will occur when the finger contact scan controlled by the contact scan counter 6 encounters the beginning of a sequence of switch contact closures covered by a single finger. The output logic "1" state signal from the edge detector 15 is called the START FINGER or start signal. In a similar fashion, edge detector 16 will generate a logic "1" signal if the sequence of input data from AND-gate 14 contains a "1" logic state followed by a "0" logic state. This change in logic states will occur when the finger scan contact scan controlled by the contact scan counter 6 encounters the end of a sequence of switch contact closures covered by a single finger. The output logic "1" state signal from the edge detector 16 is called the END FINGER or end signal.

Figure 5:
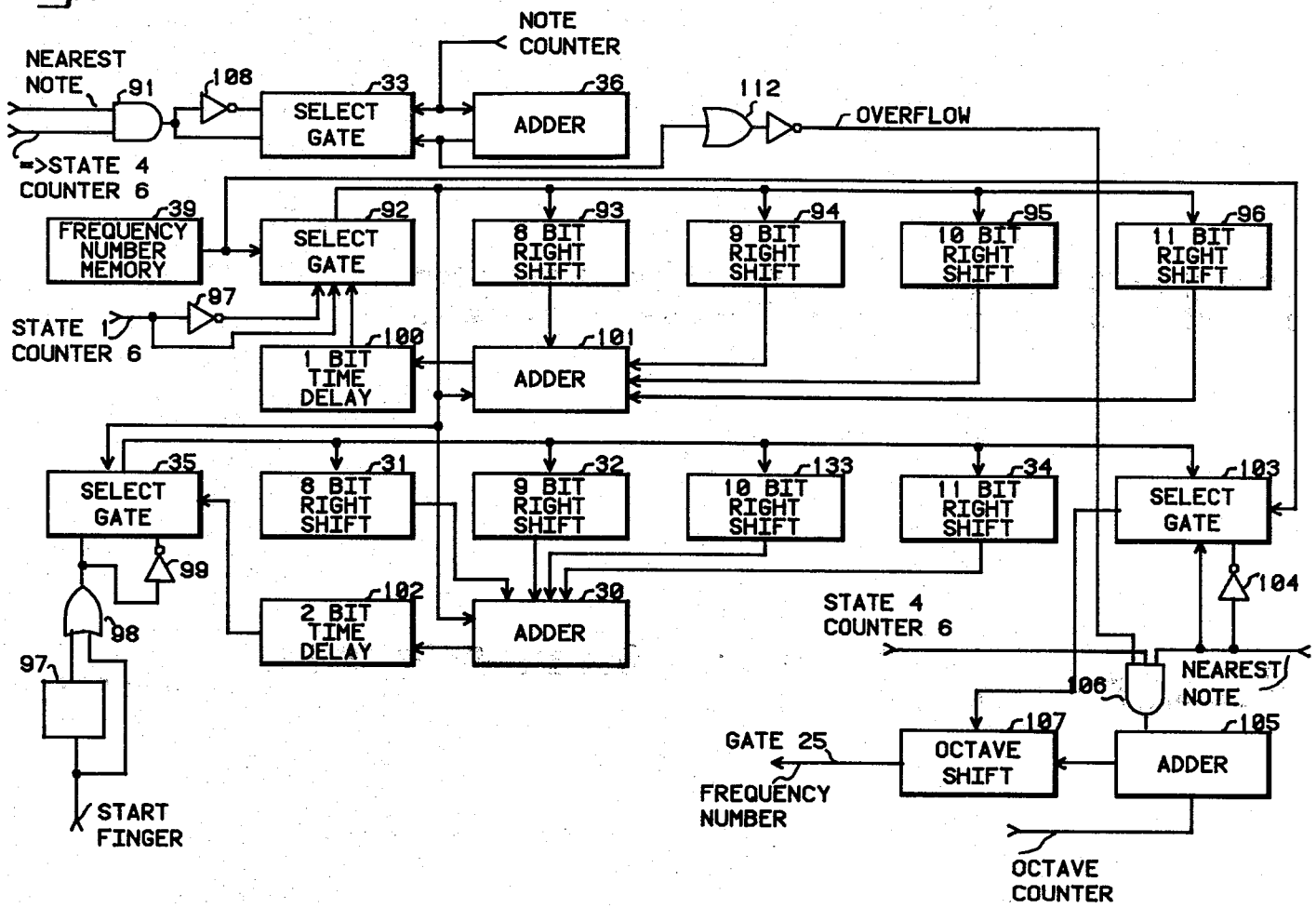
FIG. 5 is a schematic of the frequency number generator.

The details of the generation of the frequency numbers by the frequency number generator 17 is shown in FIG. 5 and described later.

The number of fingers in contact with the finger-board 59 is counted by means of the finger counter 18. The finger counter 18 is incremented by the END FINGER signal generated by means of the edge detector 16. The finger counter 18 is reset at the end of a complete finger-board scan by the logic state "1" signal generated by AND-gate 8 which is transmitted through the OR-gate 19.

The finger counter 18 is implemented to count modulo 4. This is one more than the maximum design number for the number of tone generators assigned to the finger-board 59. If the finger counter 18 has not been incremented to its maximum count state, AND-gate 17 will transfer END FINGER signals to increment the count states of this counter. This arrangement allows only the first three detected fingers on the finger-board to be counted. Any additional fingers, which may be in contact with the finger-board 59, are ignored.

If the finger counter 18 has been incremented to its highest count state (state 4), AND-gate 20 will generate a SCAN RESET signal in response to an END FINGER signal generated by edge detector 16. The SCAN RESET signal resets the finger counter 18, the note counter 2, and the octave counter 3. In this fashion, the finger-board scan is terminated as soon as the full design quota of three fingers has been detected. This logic reduces the average scanning time in those cases in which all three fingers are in contact with the finger-board 59.

The set of three frequency number registers 21 through 23 are used to capture and store the frequency numbers created by the frequency number generator 17. The generated frequency numbers are transmitted to all the frequency number registers via the gate 25. The set of three select gates 24, 26 and 27 determine which frequency number register will receive and store a frequency number at any given time.

The gate 25 will transmit the current generated frequency number if the end of a scan signal has not been generated as indicated by a logic "0" state at the output of AND-gate 8.

A frequency number will be stored in the frequency number register 21 if the END OF SCAN signal has been generated and no finger has been detected to be in contact with the finger-board 59 as indicated by the count state 1 of the finger counter 18, or if a first finger has been detected (count state 2 of the finger counter) and an END FINGER signal is generated.

A frequency number will be stored in the frequency number register 22 if the END OF SCAN signal has been generated and if the finger counter 18 is in either the count states 1 or 2, or if the finger counter is in count state 3 (indicating that at least two fingers have been detected) and an END FINGER signal is generated.

A frequency number will be stored in the frequency number register 23 if the END OF SCAN signal has been generated and the finger counter 18 is not in its count state 4, or if the finger counter is in count state 4 (indicating that three fingers have been detected) and an END FINGER signal is generated.

The net result of this assignment logic is that at the end scan for each detected finger, the frequency number generated corresponding to that finger is stored in the frequency number register corresponding to the state of the finger counter. Moreover, when an end of scan signal is generated a frequency number equal to zero is stored in the remaining registers which have not been assigned, if any such exist.

It should be noted that at the end of each scan of the finger-board 59, a frequency number has been stored in each of the three frequency number registers for any combination of three detected fingers, even for the case of no fingers in contact with the finger-board 59.

The one-bit time delay 28 and the CARRY signal input to the OR-gate 10 is used to accommodate the situation in which a single finger spans contact switches assigned to two adjacent musical notes. If a finger has been positioned to contact sets of switches corresponding to adjacent notes, then the highest contact for the lowest of these notes must of necessity be actuated. Thus if switch contacts corresponding to adjacent notes are simultaneously spanned, a "1" logic state must exist for the switch contact corresponding to the highest switch contact corresponding to the lowest of the two notes. The output signal from contact latches 11 corresponding to highest switch contact of the set of 8 switches for each note is delayed one bit time by means of the delay 28 and the delayed signal is the CARRY signal input to the OR-gate 10. Thus if two adjacent notes are spanned, the delayed CARRY signal will cause the flip-flop 4 to be reset and thereby force the note counter 2 to advance to the next highest note at which time the note counter 2 and octave counter 3 are immediately frozen in their respective count states.

The detailed logic comprising the frequency number generator 17 is shown in FIG. 5. The frequency numbers are generated by starting with a frequency number that is stored in the frequency number memory 39 for each of the 12 notes in the lowest musical octave. For the case being described, this octave extends from $C_4$ to $B_4$ (261.6 to 493.9 Hertz). At each bit time the frequency number accessed from the frequency number memory 39 is multiplied in a fixed constant multiplier by the value $K=1.007246412$ (binary number representation is 1.00000001111), which is an approximation to the frequency ratio corresponding to adjacent switches on the finger-board 59. The true ratio is $2^{[1/(12\times 8)]}=2^{1/96}$. The approximation to the true ratio of $K=1.00724612$ is chosen as 1.007324219. This approximate value has sufficient accuracy for a portamento frequency determining system, and it is an advantageous choice because of the circuit economy in the means for implementing a fixed constant multiplier having this value as the fixed constant multiplier.

The frequency number generator 17, as shown in FIG. 5, is capable of operating in two frequency modes. The first mode, called the fretted mode, generates a frequency number corresponding to the closest musical note to a contact spanned by a finger on the finger-board 59. The second mode, called the unfretted mode or the nearest note mode, generates a frequency number corresponding to the center of a finger in contact with the finger-board 59.

If the nearest note signal is not present (generated by an instrument console switch), select gate 33 will select a count state of the note counter 2 if the present count state of the contact scan counter 6 is in count state 4, otherwise the select gate will select the output of adder 36. Adder 36 adds one module 12 to the state of the note counter 2. If the nearest note signal is present then at a count state of 4 or higher from the contact scan counter, the select gate 33 will transmit a value corresponding to the next highest note of the state of the note counter. This logic is used to compensate for the situation in which a finger spans switches corresponding to adjacent notes on the finger-board 59. If the contact scan counter is in count state 4, then the center of the finger is assigned to the higher of the two adjacent notes.

If the addition of one to the note counter causes a reset because of the modulo 12 adding implementation, all the signals from the output of adder 36 will be in the "0" logic state so that the NOR-gate 112 output will be a logic "1". The output from the NOR-gate 112 is called the OVERFLOW. The OVERFLOW signal signifies that an octave has been bridged by the addition of one note to the note counter.

The data selected by select gate 33 is used to address a frequency number memory 39. The accessed frequency number is transferred as a data input to the select gate 92 and the select gate 103. The frequency number selected by select gate 92 is multiplied by the constant K at each clock time furnished by master clock 1 by means of the combination of the right binary shifts 93 through 96 and the adder 101. The value of the frequency number selected by the select gate 92 is multiplied by K and then delayed by one bit time by means of the 1 bit time delay 100.

Select gate 92 will select the frequency number accessed from the frequency number memory 39 if the note scan counter 6 is in its lowest count state of 1. For all other states, the select gate 92 will select the mulitplied value furnished by the 1 bit time delay 100. In this fashion the frequency number is updated for the time corresponding to the scan of the first of the group of 8 switch contacts corresponding to each note. As the finger scan advances to each succeeding switch state, the prior frequency number is multiplied by the fixed multiplier K and is furnished as a data input to the select gate 35. The result is that the data input to the select gate 35 is the current value of the frequency number for each scanned switch state on the finger-board 59.

The remainder of the logic shown in FIG. 5 is used to select the frequency number corresponding to the center of the group of key switches spanned by a single finger.

The select gate 35 will select and transmit as an output the current frequency number selected by the select gate 92 if the START FINGER signal is in the logic state "1". If this signal is in the logic state "0" then the frequency number furnished at the output of the 2 bit time delay 102 is selected. The frequency number selected by the select gate 35 is multiplied by the constant K at each clock time furnished by the master clock 1 by means of the combination of the right binary shifts 31 through 34 and the adder 30.

The frequency number at the output of the adder 30 is delayed by 2 bit times before it is transferred to the select gate 35. The delay of 2 bit times is used to have the selected frequency number approximately correspond to the switch contact closest to the middle element of the set of switches spanned by a single finger.

Select gate 103 will select and transfer the frequency number at the output of the select gate 92 if the system is in the fretted mode, or nearest note mode, of operation. If the unfretted mode of operation has been chosen, select gate 103 will select and transfer the frequency number at the output of the select gate 35.

If the unfretted mode of operation has been selected, then the frequency number transferred by the select gate is transmitted to the octave shift 107. The octave 107 will perform a left binary shift on the frequency numbers in response to the state of the octave counter 3 which is transmitted to the octave shift 107 via the adder 105. A left shift of one binary bit position is made for the value of one less than the count state of the octave counter 3.

Adder 105 will add the value of one to the state of the octave counter 3 if the nearest note, or fretted, mode is active, if an OVERFLOW signal has been generated by the NOR-gate 112, and if the contact scan counter 6 is in its count state 4, or higher.

The frequency number at the output of the octave shift 107 is the output of the frequency number generator 17 shown in FIG. 4.

The finger-board layout shown in FIG. 1 is designed for a linear spacing of notes which somewhat resembles a piano-type keyboard. A closer imitation of a piano-keyboard configuration can be implemented by using two parallel linear arrays of switch contacts. The first array contains contacts corresponding to the "white" notes and the second array contains the contacts corresponding to the "black" notes. The second array can be raised to approximate the location of the "black" keys on a piano keyboard.

A further alternative layout for the finger board is to space the contacts to correspond to the fret spacings in a stringed instrument such as a member of the guitar family. The advantage of such a switch configuration is that it enables a musician familiar with stringed instruments to "play" the portamento fingerboard in the same manner as stringed instruments. The system has the dual operation choices of fretted and unfretted modes which provides a means for combining the versatility of stringed instrument techniques with the versatility of electronic tone generators of the polyphonic tone synthesizer type. The use of a polyphonic portamento as embodied in the present invention provides new dimensions in the musical effects.

Figure 6:
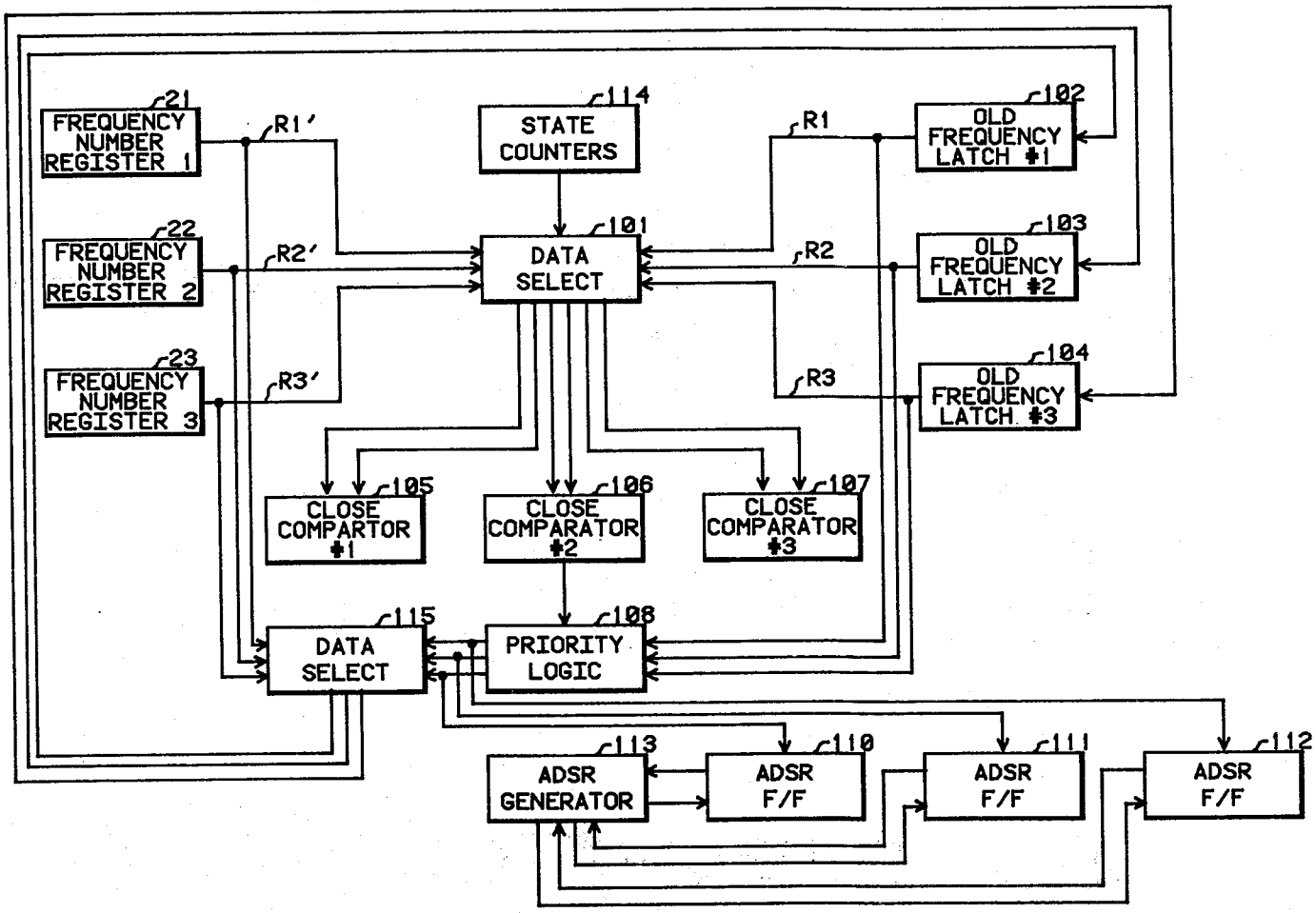
FIG. 6 is a system block diagram of a closest frequency assignor.

FIG. 6 shows a system block diagram for an assignor based on a criterion of closest frequency which also creates control signals for an ADSR generator 113.

The frequency number for the current finger-board scan are denoted by the symbols R1', R2' and R3' and are stored in the frequency number registers 21–23 as described above. At the start of a finger-board scan data select 115 causes a transfer of the frequency numbers R1', R2' and R3' to the set of three old frequency latches 102–104. Therefore these latches contain the frequency numbers assigned during the immediate prior scan of the states of the finger-board switches. The old frequency numbers are designated by the symbols R1, R2, R3. Although for illustrative purposes the invention is described for a three note polyphonic portamento system, it is obvious that the logic can be extended to any desired number of tone generators.

Under control of the state counters 114, in a manner described later, the data select 101 selects values of the old frequency numbers R1; $i=1,2,3$ to be compared with the current frequency numbers Rj' $j=1,2,3$. The comparison is accomplished by means of a three step process.

In the first comparison step, the old frequency number R1 is selected and transferred by the data select 101 to one input of each of the set of close comparators 105–107. The second input to the close comparator 105 is the new frequency number R1'; the second input to the close comparator 106 is the new frequency number R2'; the second input to the close comparator 107 is the new frequency number R3'.

In the second comparison step, the data select 101 also selects and assigns the three new frequency numbers in the same manner as in the first comparison step but now the common input to the three close comparators is the old frequency number R2.

In the third comparison step the data select 1021 also selects and assigns the three new frequency numbers in the same manner as in the first comparison step but now the common input to the three close comparators is the old frequency number R3.

The output of each of the close comparators for each comparison step is a closeness data value which is a measure of how close a new frequency number is to an old frequency number generated from the previous scan of the switch states of the finger-keyboard.

Figure 7:
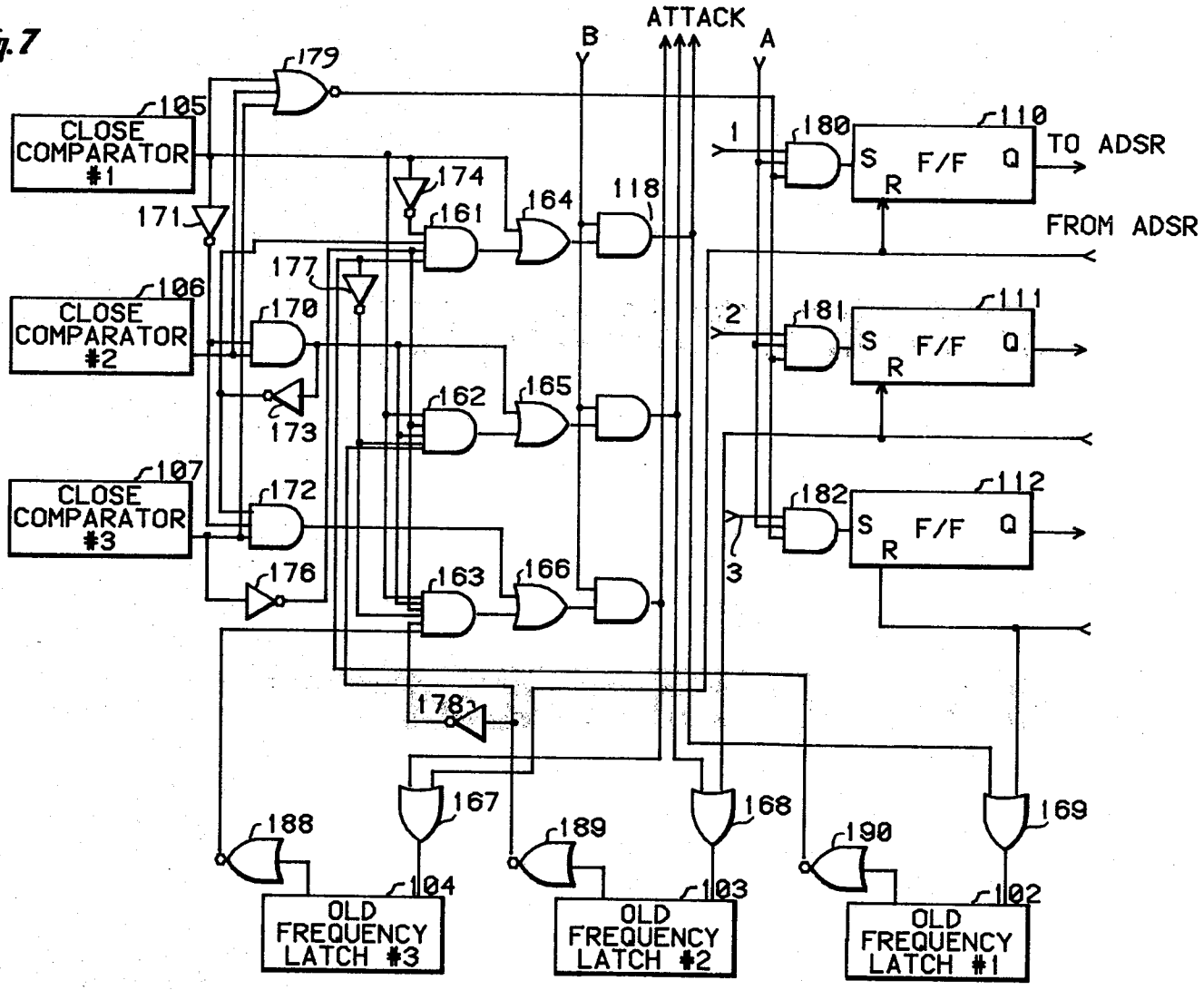
FIG. 7 is a schematic of the priority assign logic.

The priority assign logic, shown in detail in FIG. 7, makes an assignment decision between the closeness data values provided by each of the three close comparators 105–107. The output of each of the close comparators is a logic state "1" or "0". The "1" state is generated if the old and new frequency numbers present at a close comparator's input terminals correspond to a frequency difference less than some preassigned value. A frequency difference of 50 cents is an advantageous choice. This corresponds to ½ of a note interval in a musical scale, or a change of 1.0129 times the value of the lower of the two frequencies.

The finger board 59 is scanned in the direction of low to high frequencies. Therefore the priority assign logic will select a "1" logic state from the lowest numbered close comparator if more than one output from the close comparators has a "1" state output signal.

Suppose that the output state from close comparator 105 is "0" and the output states for the remaining close comparators are "1". The output state of AND-gate 170 will be "1". This will place a "0" state as one of the input signals to the AND-gate 172 which will result in an output state of "0". The invertor-173 places a "0" state as an input to AND-gate 161 which in turn places the second input line to the OR-gate 164 in the "0" state. Thus the output state of OR-gate 164 is "0".

The "1" state from AND-gate 170 is transferred to the output of OR-gate 165. The "1" state of AND-gate 170 is inverted to a "0" by invertor 173 so that a "0" state appears at the output of AND-gate 172 which is transferred as one of the signal inputs to the OR-gate 166. The "1" state from the close comparator 107 is inverted to a "0" by the invertor 176 and appears as one of the input signals to the AND-gate 163. The result is that a "0" state is transferred as the second input to the OR-gate.

It is seen that the desired logic states have been implemented in that the "1" state has been selected from the lowest numbered close comparator, in this case it is close comparator 106 if more than one output is a "1" from the detected close comparators. Examination of the logic will show the desired action for other combinations of output states from the set of three close comparators. The priority selection at any time is contained in the logic states of the three OR-gates 164–166.

When the ADSR generator 113 completes the release segment of the tone generator envelope modulation for any of three tone generators, an end signal is transmitted to reset the member of the set of flip-flops 110 through 112 which corresponds to that tone generator. The same end signal is transferred to a member of the set of three OR-gates 167 through 169 to one of the old frequency latches 102–104. This signal causes the old frequency latch to be initialized to a zero-valued frequency number.

Almost any of the known methods can be used to implement the ADSR generator 113. In U.S. Pat. No. 4,079,650 entitled "ADSR Envelope Generator" there is described an ADSR generator which provides envelope modulation functions for a polyphonic musical instrument. This patent is hereby incorporated by reference.

If the situation occurs in which, at the end of any comparison step, each of the output states of the close comparators 105–107 is in the "0" state, then the priority logic will make a decision using only the values of the frequency numbers R1 stored in the old frequency latches 102–104. The selection logic is implemented so that the selection will be made from the lowest frequency latch 102–104 which has a non-zero value indicating the lowest note contact that was actuated on the previous finger-board scan.

To illustrate the above decision logic, assume that each of the close comparators 105–107 has a "0" output state signifying that none of the frequency numbers is close to any of the frequency numbers generated from the previous finger-board scan. In addition suppose that two of the old frequency numbers have a zero value and only one, say R3, has a non-zero value. For this situation, the desired priority logic is to state the frequency number for the single detected note in the lowest numbered old-frequency latch 102.

The output states from NOR-gates 190 and 189 will be both "1" because at the start of the comparison steps R1=R2=0. The invertors 177 and 178 will cause a "0" state to appear at the output of AND-gates 162 and 163. Since the second signal leads to the OR-gates 165 and 166 are "0" from the output states of the corresponding close comparators, then a "0" state appears at the output of both OR-gates 165 and 166. Next examine the four input signal lines to AND-gate 161. The top line has a "1" state because of the inversion of a "0" state from close comparator 105 by means of the invertor 174. The second line has a "1" state because the "0" state output from AND-gate 170 is inverted to a "1" by the invertor 173. The third line has a "1" because the "0" state output from close comparator 107 is inverted as a "1" by the invertor 176. The fourth line has the "1" state transferred by the NOR-gate 102. The net result is that a "1" state is generated at the output of AND-gate 161 and transferred to the OR-gate 164.

The same type of signal tracing will demonstrate the system operation for other combinations of non-zero data stored in the old-frequency latches 102–104.

Figure 8:
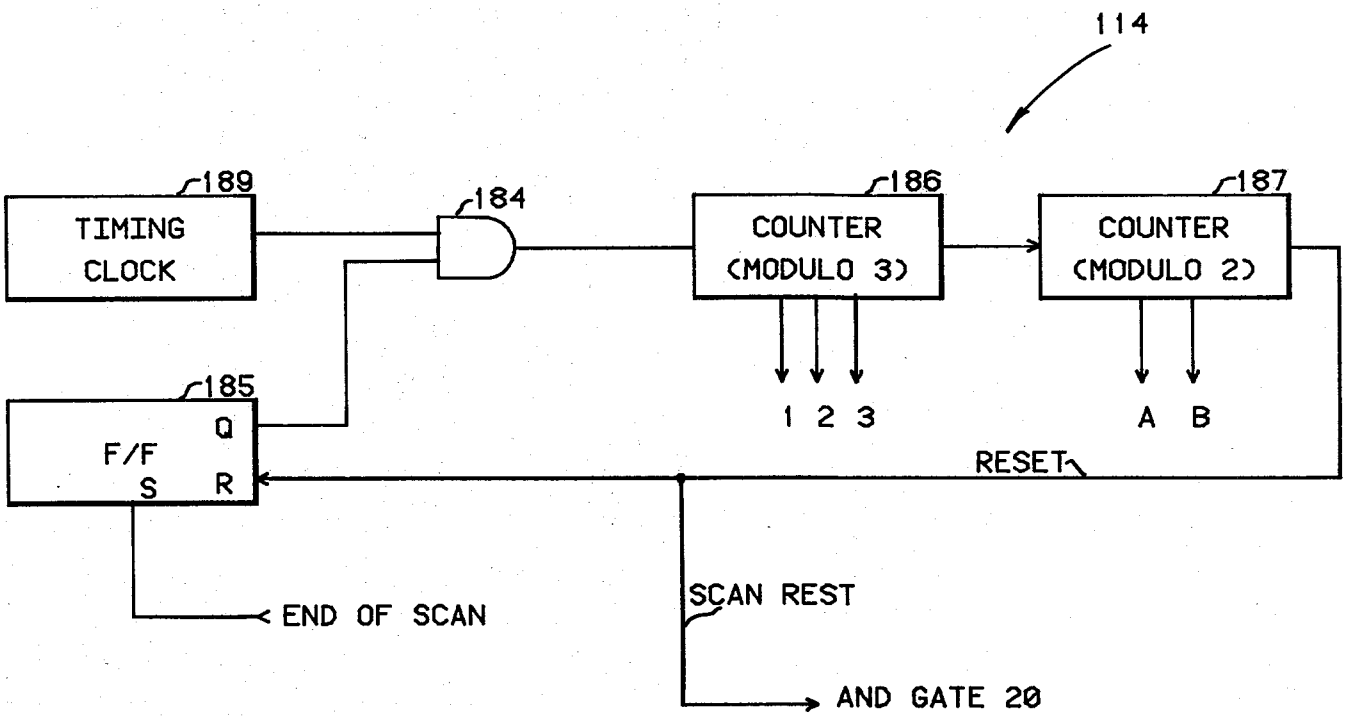
FIG. 8 is a schematic drawing of the state counters.

FIG. 8 illustrates the details of the state counter 114. The flip-flop 185 is set by the END OF SCAN signal producing a state Q="1". In response to Q="1", AND-gate 184 transfers timing signals from the timing clock 189 to increment counter 186. Timing clock 189 runs at six times the frequency of the master clock 1. An alternative implementation is to frequency divide the timing signals from the timing clock 189 by means of a modulo six counter to obtain the signals for the master clock 1 output. Counter 186 counts the timing signals modulo 3. Each state of the counter 186 corresponds to one of comparison steps previously described. The binary states of the counter 186 are decoded onto the signal lines denoted by the integers 1,2,3. The signal states on these signal lines are used by the data select 101 to select the various frequency numbers and transmit them to the set of close comparators 105–107 as previously described.

Each time that counter 186 returns to its initial state because of its modulo counting implementation, a signal is transmitted which increments the count state of counter 187. Counter 187 is implemented to count modulo 2. The two binary count states are decoded onto the signal lines labeled A and B. As shown in FIG. 7, if the signal line A has a logic signal "1", then flip-flops 110 through 112 can be set in turn by the states of counter 186. When any of the flip-flops 110–112 has been set, a signal is sent to the ADSR generator 113 which causes a decay phase to be generated.

The B signal line from counts 187 is used as a control signal to the set of three AND-gates 118 shown in FIG. 7. When the B signal line is in the logic state "1", the result of the priority select logic appearing at the output of the OR-gates 184–186 is transferred to assign circuitry.

When counter 187 is reset to its initial state because of its module counting implementation, a RESET signal is generated which resets the flip-flop 185 thereby inhibiting timing signals from incrementing the counter 186. The RESET signal is also used as a signal input to AND-gate 20 (FIG. 4), thereby permiting the start of the next contact scan of the finger keyboard 59.

During the A-phase state of counter 187, the system logic checks the finger-board contact states to determine if a note has been released while ignoring displacements of the fingers. During the B-phase state of counter 187, if a new note has been attacked, a signal will appear on the corresponding ATTACK lines connected to the output of the AND-gates 118. A signal on this line will initiate the generation of an ADSR envelope modulation function. If a note has been released, then the corresponding decay flip-flop in the set 110–112 will be set. The setting of any of these flip-flops will cause the ADSR generator to start generating the release segment, or release phase, of an ADSR envelope modulation function. When an individual ADSR generator has completed its release phase, a signal is sent back to reset the corresponding decay flip-flop in the set 110–112. However this reset signal is delayed until the flip-flop 185 (FIG. 7) has been reset and a new fingerboard scan has been initiated.

During state B of the counter 187 (FIG. 8), the set of AND-gates 118 (FIG. 7) permit the closeness data output from the comparison and priority logic to be transferred to the set of old frequency latches 102–104. A signal on these lines enables the assigned old frequency latch to receive its assigned frequency number. If a given note has completely finished the release phase of its ADSR envelope modulation function, then the signal transmitted from the ADSR generator 113 will cause a zero-value frequency number to be stored in the corresponding old frequency latch.

Figure 9:
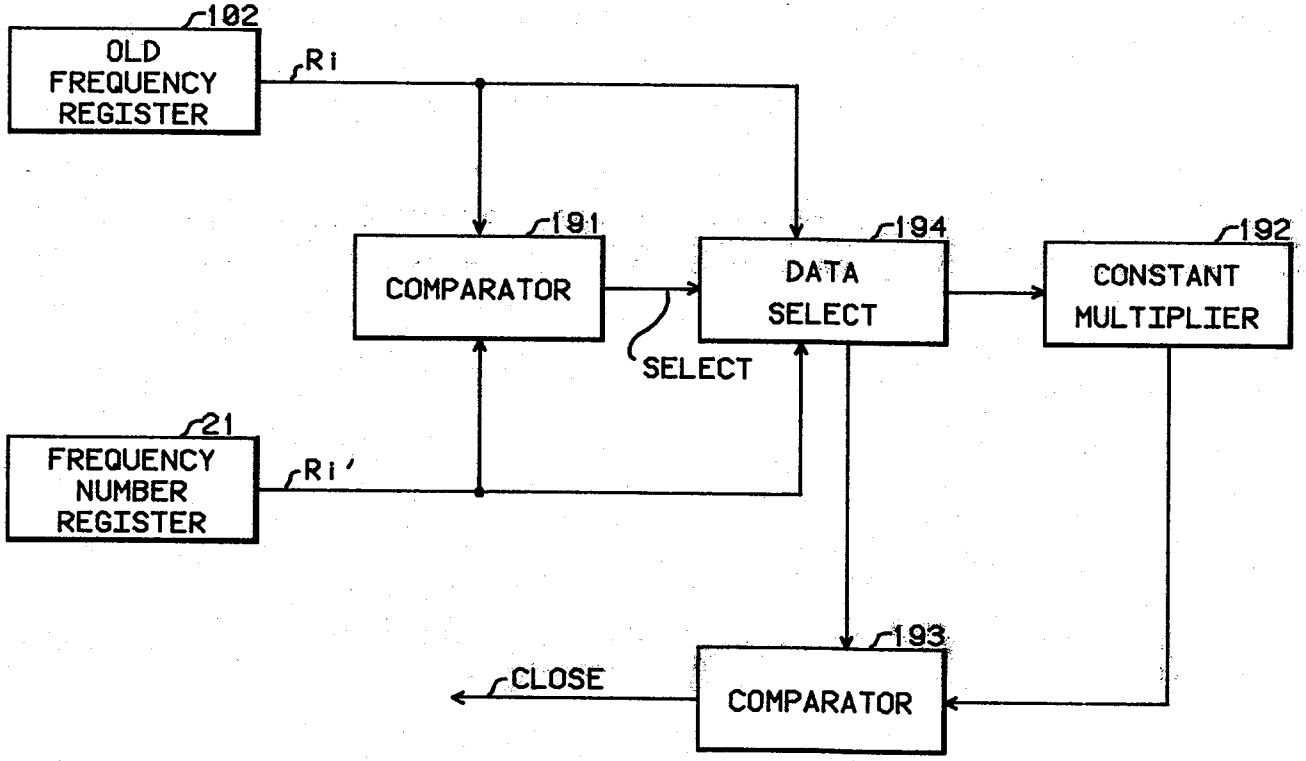
FIG. 9 is a schematic drawing of a close comparator.

FIG. 9 illustrates the implementation of one of the close comparators of the set 105–107. The old frequency number R1 and the new frequency number R1' are compared in the comparator 191. The SELECT signal is sent to the data select 194 to cause it to select the smaller of the two frequency numbers and transmit the selected number to the constant multiplier 192. The larger of the two frequency numbers is selected by the data select 194 and transmitted to be one of the data input signals to the comparator 193.

The constant multiplier 192 multiplies the smaller frequency number by the value $2^{1/24}$. This is the ratio between two frequencies separated by one-half of a musical note frequency difference.

The output of the constant multiplier 192 is compared with the largest of the two input frequency numbers in the comparator 193. If the two numbers are less than some prespecified constant value, a CLOSE signal is placed in the logic state "1", if not then the close signal is placed in the "0" logic state. An advantageous choice for the closeness constant value is the decimal value 0.00008. This corresponds to a binary value of 0.000 000 001 which is easy to implement in a binary value magnitude comparator.

Figure 10:
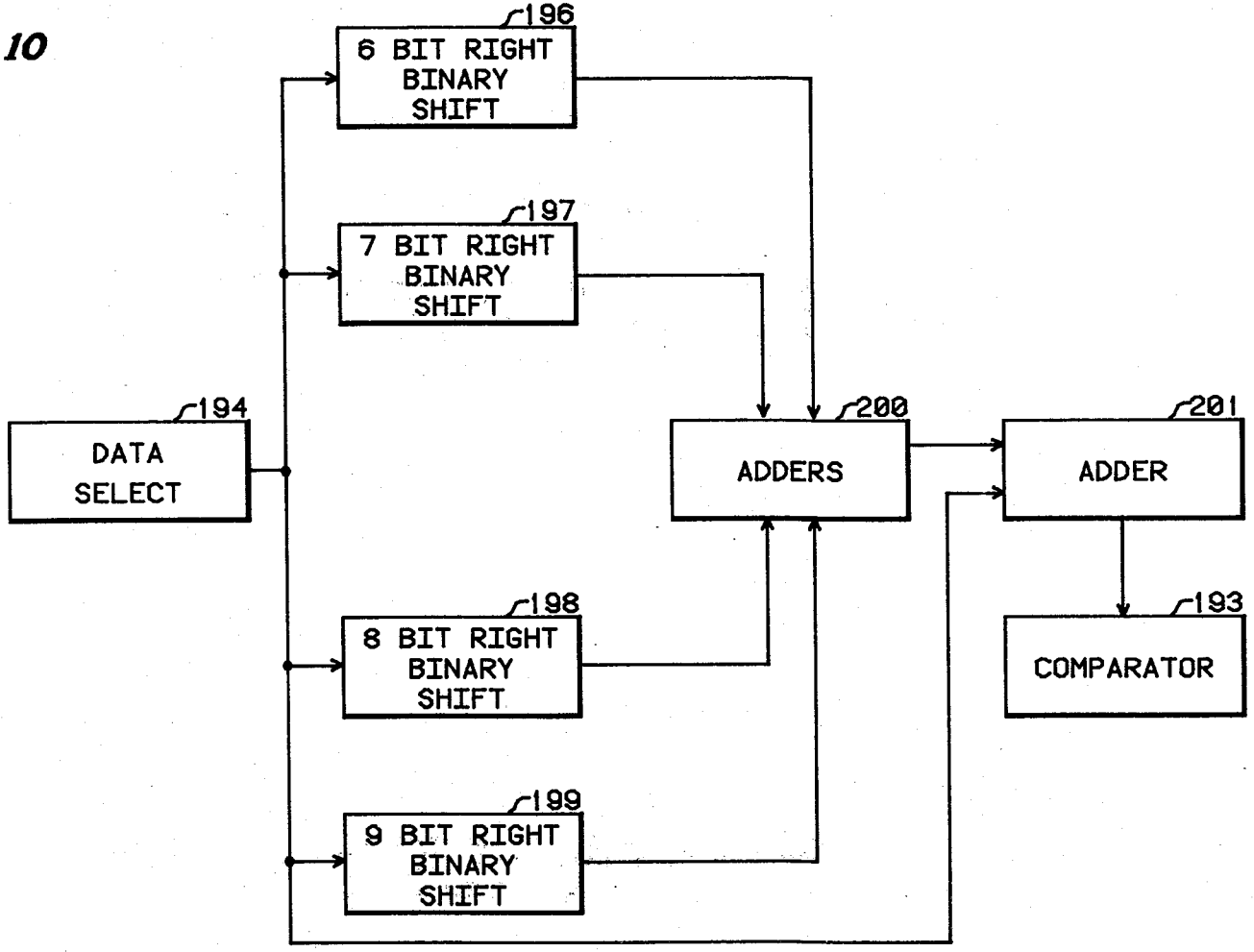
FIG. 10 is a schematic diagram of a constant value multiplier.

FIG. 10 shows the details of a constant value multiplier used to implement the constant multiplier 192. This system is analagous to the constant value multipliers used in the frequency number generator 17 which were shown in detail in FIG. 5. A good binary approximation to the decimal number $2^{1/24}$ is 1.000 001 111. The right binary shifts 196–199 implement the components of the required fractional values of the frequency numbers selected by the data select 194. The set of binary fractions generated by the binary right shifts are summed in the adders 200 and then the sum is added to the input frequency number in adder 201 to provide the scaled frequency number value to the comparator 193.

The invention has been illustrated using a tone generation system in which musical frequencies are generated from frequency numbers. Since the frequency numbers only differ by some constant from the musical frequencies, the same system can just as well be implemented using frequency values in place of frequency numbers.

In keyboard musical instrument design it is common practice to designate each note on the keyboard with a number. For instruments of the organ variety, the number 1 is used to designate the musical frequency $C_2$, corresponding to a frequency 65.41 Hz. The note number increases with an increase in frequency. The note numbers bear a logarithmic relation with the musical frequencies. Thus the note number N can be computed according to the relation $$N=1+[12/\log 2][\log (f_1/f_0)], \quad \text{Eq. 1}$$

where $f_0$ is frequency corresponding to the note $C_3$. The assignment logic can also be implemented using note numbers, which are permitted to have fractional values. The principal change is in the close comparators which must make decisions based upon logarithmic differences instead of linear differences of the numbers to be compared.

We claim:

1. In a keyboard operated electronic musical instrument in which the pitches of the generated tones are determined by frequency numbers corresponding to actuated keyboard switches, apparatus for providing polyphonic portamento effect in response to the lateral displacement of any number of N player fingers in contact with said keyboard switches and for providing tones with ADSR envelope modulation functions in response to the contact of said N player fingers with said keyboard switches comprising:

a switch array comprising a multiplicity of keyswitches arranged in a linear array such that a plurality of contiguous keyswitches is actuable by each of said N fingers in contact with said switch array, a scanning means for providing scanning signals to said switch array, a detection means responsive to said scanning signals whereby detection signals are generated corresponding to each actuated keyswitch in said switch array, a center detection means responsive to said detection signals whereby a note signal is generated corresponding to each one of said N player fingers in contact with said switch array, a frequency number generator responsive to each said note signal wherein said frequency numbers are generated thereby producing said polyphonic portamento effect corresponding to the lateral displacement of said player fingers in contact with said keyboard switches, an envelope generator means for creating said ADSR envelope modulation functions in response to a control signal, a note assignor means responsive to said detection means whereby said control signal is generated corresponding to each of said N player fingers placed in contact with said switch array, a tone generation means responsive to said frequency numbers whereby musical tones are generated at pitches corresponding to said frequency numbers, and an envelope modulation means for modulating each of said musical tones by a corresponding one of said ADSR envelope modulation functions thereby producing said tones with an ADSR envelope modulation function in response to the contact of said N player fingers in contact with said key board switches.

2. A musical instrument according to claim 1 wherein said switch array comprises;

a multiplicity of keyswitches each having an output terminal and an input terminal arranged in groups of a number M of keyswitches and such that each one of said groups of keyswitches corresponds to a musical note for said keyboard operated electronic musical instrument, switch logic circuitry whereby said scanning signals are applied to each input terminal of said multiplicity of keyswitches, and whereby said input terminals for said keyswitches in each said group of M keyswitches are connected together, and switch interconnect circuitry responsive to said scanning signals whereby said scanning signals transferred to the output terminals of corresponding actuated keyswitches in each of said group of keyswitches of number M are combined on one member of a plurality of common output signal lines.

3. A musical instrument according to claim 2 wherein said scanning means comprises;

a master clock for providing timing signals, a note counter means for counting said timing signals modulo a number Q, reset signal generation means whereby a reset signal is generated when said note counter returns to its minimum count state, an octave counter means for counting said reset signals modulo a number W, an end of scan generator responsive to count states of said note counter and said octave counter wherein an end of scan signal is generated when both said note counter and said octave counter are simultaneously in their respective maximum count states, a scan inhibit gate interposed between said master clock and said note counter means whereby in response to a scan control signal said timing signals are provided to said note counter means and whereby if said scan control signal is not present said timing signals are not provided to said note counter means, and p1 scan logic circuitry whereby said scanning signals are generated in response to count states of said note counter means and said octave counter means.

4. A musical instrument according to claim 3 wherein said detection means comprises;

a contact memory for storing said scanning signals appearing on said plurality of common output signal lines in response to a write signal, a contact scan counter means for counting said timing signals modulo said number M, write signal circuitry whereby said write signal is generated when said contact scan counter means is in its minimum count state, and a timing signal gate means interposed between said master clock and said contact scan counter means whereby a sequence of said timing signals of said number M are provided to said contact scan counter means if said scanning signals are present on any member of said plurality of common output signal lines.

5. A musical instrument according to claim 4 wherein said detection means further comprises;

addressing circuitry for reading out said scanning signals stored in said contact memory in response to count states of said contact scan counter means, a first detector means responsive to scanning signals read out from said contact memory wherein a start signal is generated corresponding to the lowest state of said contact scan counter means for which a non zero signal state is addressed out from said contact memory means, and a second detector means responsive to scanning signals read out from said contact memory wherein an end signal is generated corresponding to the lowest state of said contact scan counter means for which a zero signal state is addressed out from said contact memory if said zero signal state is preceded by a non zero signal state addressed out from said contact memory.

6. A musical instrument according to claim 5 wherein said detection means further comprises;

note overlap circuitry whereby said contact scan counter means is reset to a minimum count state after a time delay of one of said timing signals if a zero signal state is addressed out of said contact memory means corresponding to the maximum count state of said contact scan counter means thereby scanning said groups of keyswitches corresponding to adjacent musical notes.

7. A musical instrument according to claim 6 wherein said detection means further comprises;

a finger counter means incremented by said end signal and which counts modulo one plus said number N, counter inhibit means whereby said end signal is inhibited from incrementing said finger counter means if the finger counter means is in its maximum count state, counter reset means responsive to said end of scan signal whereby said finger counter means is reset to a minimum count state, and scan reset circuitry whereby said note counter means and said octave counter means are reset to their minimum count states in response to said end signal if said finger counter means is in its maximum count state.

8. A musical instrument according to claim 7 wherein said frequency number generator comprises;

mode control circuitry responsive to a mode signal whereby if said mode signal is present said frequency numbers are generated corresponding to each said note signal and whereby if said mode signal is not present said frequency numbers are generated corresponding to the musical notes associated with each of said groups of M keyswitches having a keyswitch in an acuated state, a plurality of frequency number memories, each corresponding to one of said N fingers, for storing said frequency numbers, and frequency number addressing means responsive to contents of said finger counter means for writing said frequency numbers in corresponding members of said plurality of frequency number memories.

9. A musical instrument according to claim 8 wherein said frequency number generator further comprises;

a frequency table memory for storing a plurality of frequency numbers, a memory addressing means for reading out frequency numbers from said frequency table memory in response to a state of said note counter means, multiplier means for successively multiplying frequency numbers read out from said frequency table memory by a number $$K=2^{[-T/(12\times M)]}$$

to generate an offset frequency number, where M is said number of keyswitches in said group of keyswitches and T is a number corresponding to the count state of said contact scan counter means and provided as an input state signal to said multiplier means, and octave shift means whereby said offset frequency number is scaled by a left binary shift corresponding to the count state of said octave counter means.

10. A musical instrument according to claim 9 wherein said multiplier means comprises;

offset generating means responsive to said start signal whereby one of said offset frequency numbers is generated corresponding to each said note number.

11. A musical instrument according to claim 10 wherein said frequency number generator further comprises;

offset number selection means responsive to said mode signal whereby said frequency number read out from said frequency number memory is provided to said octave shift means if said mode signal is not present and whereby said offset frequency number is provided to said octave shift means if said mode signal is present.

12. A musical instrument according to claim 11 wherein said note assignor means comprises;

a plurality of first memory means, equal in number to said number N, for storing said generated frequency numbers, a plurality of second memory means, equal in number to said first memory means, for storing said generated frequency numbers, and a frequency number select means responsive to priority control signals for storing frequency numbers generated by said frequency number generator in said plurality of first memory means and in said plurality of second memory means.

13. A musical generator according to claim 12 wherein said note assignor means further comprises;

priority logic means for generating said priority control signals responsive to frequency numbers stored in said plurality of first memory means and in said plurality of second memory means, and control signal generating means responsive to said priority control signals for generating said control signals.

14. A musical instrument according to claim 13 wherein said priority logic means comprises;

a first counter means for counting said timing signals modulo said number N, wherein a first reset signal is generated when said first counter means is incremented to its lowest count state, a second counter means for counting said first reset signal modulo 2, wherein a priority reset signal is generated when said second counter means is incremented to its lowest count state, and scan inhibit means whereby said end signal is provided to said scan reset circuitry in response to said generated priority reset signal.

15. A musical instrument according to claim 14 wherein said priority logic means comprises;

a plurality of close comparator means equal in number to said number N, and comparison data select means responsive to states of said first counter means whereby first input frequency numbers are read out of said plurality of first memory means and second input frequency numbers are read out from said plurality of second memory means and said read out frequency numbers are provided to said plurality of close comparator means.

16. A musical instrument according to claim 15 wherein said plurality of close comparator means comprises;

comparator circuitry responsive to a first input frequency number read out from said plurality of first memory means and to a second input frequency number read out from said plurality of second memory means wherein a close signal is generated if said first input frequency number is less than some preassigned value from the value of said second input frequency number.

17. A musical instrument according to claim 16 wherein said priority logic means further comprises;

priority select circuitry responsive to said close signals generated by said plurality of close comparator means whereby said control signal are generated if said second counter means is in its lowest count state, and memory address circuitry responsive to said close signals whereby first input frequency numbers addressed out from said plurality of first memory means are written into said plurality of second memory means if said second counter means is in its highest state and whereby frequency numbers generated by said frequency number generator are written into said plurality of first memory means.

18. A musical instrument according to claim 16 wherein said comparator circuitry comprises;

a first comparison means whereby a comparison select signal is generated if said first input frequency number is greater than said second input frequency number, a constant multiplier whereby frequency numbers are multiplied by a preselected constant value multiplier to provide a scaled frequency number, a second comparison means responsive to a selected frequency number and said scaled frequency number wherein said close signal is generated if said selected frequency number and said scaled frequency number differ in magnitude by said preassigned value, and data select circuitry responsive to said comparison select signal whereby the larger of said first input frequency number and said second input frequency number is provided as said select frequency number and the smaller of said first input frequency number and said second input frequency number is provided to said constant multiplier.

19. In a keyboard operated electronic musical instrument in which the pitches of the generated tones are determined by frequency numbers corresponding to actuated keyboard switches, apparatus for producing musical tones having ADSR envelope modulation functions in response to the contact of any number of N player fingers with said keyboard switches comprising;

a switch array comprising a multiplicity of keyswitches arranged in a linear array such that a plurality of contiguous keyswitches are actuable by each of said N player fingers in contact with said switch array, a scanning means for providing scanning signals to said switch array, a detection means responsive to said scanning signals whereby detection signals are generated corresponding to each actuated keyswitch in said switch array, a center detection means responsive to said detection signals whereby a note signal is generated corresponding to each one of said N player fingers in contact with said switch array, a frequency number generator responsive to each said note signal whereby said frequency numbers are generated corresponding to each of said N player fingers in contact with said switch array, a plurality of first memory means for storing frequency numbers generated by said frequency number generator, a plurality of second memory means for storing frequency numbers read out from said plurality of first memory means, priority assignment means responsive to frequency numbers stored in said plurality of first memory means and to frequency numbers stored in said plurality of second memory means whereby assignment signals are generated, and an ADSR envelope generator means responsive to said assignment signals for generating said ADSR envelope modulation functions for musical tones corresponding to each of said N player fingers in contact with said keyboard switches.

20. Apparatus according to claim 19 wherein said priority assignment means comprises;

first memory address circuitry whereby a first frequency number is addressed out from a selected member of said plurality of first memory means and whereby a second frequency number is addressed out from a selected member of said plurality of second memory means, a closeness comparator means whereby an assignment signal is generated if said first frequency number differs in magnitude from said second frequency number by some preselected closeness magnitude value, and second memory address circuitry responsive to said closeness signal whereby said second frequency number is stored in a member of said plurality of second memory means.

21. A musical instrument according to claim 19 wherein said center detection means comprises:

a center signal detection means responsive to said detection signals whereby a note signal is generated corresponding to the central keyswitch for each of said plurality of contiguous keyswitches actuated by each of said N player fingers in contact with said switch array.

22. A musical instrument according to claim 19 wherein said center detection means comprises:

a center signal detection means responsive to said detection signals whereby a note signal is generated corresponding to the central keyswitch for each of said plurality of contiguous keyswitches actuated by each of said N player fingers in contact with said switch array.

* * * * *